US007398934B1

(12) United States Patent
Capelle, Jr.

(10) Patent No.: US 7,398,934 B1
(45) Date of Patent: Jul. 15, 2008

(54) DEEP-CHAMBER, STEPPED, FLUID-ENERGY MILL

(75) Inventor: William Edward Capelle, Jr., Gulfport, MS (US)

(73) Assignee: E.I. du Pont de Nemours and Company

( * ) Notice: Subject to any disclaimer, the term of this patent is extended or adjusted under 35 U.S.C. 154(b) by 0 days.

(21) Appl. No.: 11/803,629

(22) Filed: May 15, 2007

(51) Int. Cl.
*B02B 1/00* (2006.01)
*B02B 5/02* (2006.01)
*B02C 11/08* (2006.01)

(52) U.S. Cl. ..... 241/5; 241/39

(58) Field of Classification Search ..... 241/5, 241/39, 40

See application file for complete search history.

(56) References Cited

U.S. PATENT DOCUMENTS 2,032,827 A * 3/1936 Andrews ..... 241/5
2,191,095 A 2/1940 Hobbie
2,690,880 A 10/1954 Chatelain
2,763,437 A * 9/1956 Marchant ..... 241/39
3,005,594 A * 10/1961 Vogel et al. ..... 241/39
3,559,895 A 2/1971 Fay
3,726,484 A 4/1973 Schurr
4,056,233 A * 11/1977 Fay ..... 241/39

* cited by examiner

*Primary Examiner*—Bena Miller

(57) ABSTRACT

The embodiments of the present invention relate to improvements in the fluid-energy mills. Particularly, the fluid-energy mill of the present invention includes a deeper chamber for grinding of particulate material, wherein the discontinuities defining the stepped chamber are located at a distance of about 0.59 to 0.62 R, and preferably 0.61 R, from the axis of the chamber, wherein R is the radius of the grinding chamber measured from the axis to the inside wall of the chamber. In another improvement, providing interlocking joints in the liner discharge tube and extending the liner into the port for the feed tube, as well as providing a packing gland for the feed tube mitigate the problem of wear of the ceramic liner inside the fluid-energy mill.

14 Claims, 3 Drawing Sheets

DEEP-CHAMBER, STEPPED, FLUID-ENERGY MILL

FIELD OF THE INVENTION

This invention relates to fluid-energy mills used for grinding particulate material such as titanium dioxide. The embodiments of the present invention relate to improvements in such fluid-energy mills. Particularly, the fluid-energy mill of the present invention includes a deeper chamber for grinding of particulate material, wherein the discontinuities defining the stepped chamber are located at a distance of about 0.59 to 0.62 R, and preferably 0.61 R, from the axis of the chamber, wherein R is the radius of the grinding chamber measured from the axis to the inside wall of the chamber. In another improvement, providing interlocking joints in the liner discharge tube and extending the liner into the port for the feed tube, as well as providing a packing gland for the feed tube mitigate the problem of wear of the ceramic liner inside the fluid-energy mill.

BACKGROUND OF THE INVENTION

Fluid-energy mills are used for reducing particle size of a variety of materials such as pigments, agricultural chemicals, carbon black, ceramics, minerals and metals, pharmaceuticals, cosmetics, precious metals, propellants, resins, toner and titanium dioxide. The particle size reduction typically occurs as a result of particle-to-particle collisions and particle collision with the walls.

Most fluid-energy mills are variations on a basic configuration of a disc-shaped grinding chamber enclosed by two, generally parallel, circular plates defining axial walls, and an annular rim defining a peripheral wall, with the axial length or height of the chamber being substantially less than the diameter. Around the circumference of the mill are located a number of uniformly spaced jets for injecting the grinding fluid which furnishes additional energy for comminution, along with one or more feed nozzles for feeding the particulate material to be comminuted. The jets are oriented such that the grinding fluid and particulate material are injected tangentially to the circumference of a circle smaller than the chamber circumference. Feed to the grinding chamber can be introduced either through a side inlet that is tangent to the grinding chamber, or at an angle from the top, usually at a 30° angle to the plane of the grinding chamber. Side feed micronizers generally produce the better grinding dispersion, while top feed micronizers can produce higher rates.

Within the grinding chamber, a vortex is formed by the introduction of the grinding fluid such as compressed gas, through the feed inlet or through fluid nozzles positioned in an annular configuration around the periphery of the grinding chamber. The grinding fluid (compressed gas, e.g., air, steam, nitrogen, etc.), fed tangentially into the periphery of the chamber, forms a high-speed vortex as it travels within the grinding chamber. The high-speed vortex sweeps up the particulate material, which results in high speed particle-to-particle collisions as well as collisions with the interior portion of the grinding chamber walls.

The grinding fluid velocity can be resolved into a tangential component of the velocity, $V_t$, which is a measure of the centrifugal force acting on the particle tending to keep it at the outer periphery of the chamber, and the radial component of velocity, $V_r$, which is a measure of the drag force generated by the action of the fluid against the particle tending to force the particle towards the central discharge conduit. By proper selection of conditions, such as rate and tangency of fluid injection, these opposing forces can be adjusted such that particles above a specific size are retained within the mill until sufficient attrition occurs, both by collision with other particles and the chamber walls, to reduce them to the desired sizes, up to the point when the drag forces become dominant over centrifugal forces and the particles are swept into the central discharge conduit that is coaxial to, and in direct communication with, the grinding chamber, and subsequently into a cyclone or bag filter for collection.

Clearly, heavier particles have longer residence time within the vortex. Lighter particles (i.e., those sufficiently reduced particles) move with the vortex of gas until the discharge conduit is reached. Typically, fluid-energy mills are capable of producing fine (less than 10 microns) and ultra fine (less than 5 microns) particles.

During grinding, undesirably large particle sizes frequently escape into the product. In other words, better classification of particulate material is required. Also during grinding, the inside liner of the grinding chamber is subjected to abrasion. Generally, the liner is a large casting of silicon carbide and because of its size has many joints. The joints are a potential source of problem. Particulate material and grinding fluid such as steam circulate around the liner at a velocity, for example, of about Mach 1. The momentum of even small particles at such velocities is very high. The liner is susceptible to abrasion and penetration by such particles, particularly where a joint occurs in the ceramic liner of the grinding chamber.

The fluid-energy mill of the present invention overcomes these problems, in that, it helps retain larger particles for a longer time in the chamber and discharging them only after required attrition is achieved, and it provides for interlocking joints that prevent penetration of particulate material into the ceramic liner. Consequently, the inside liner of the fluid-energy mill of the present invention lasts two to three times longer than a standard liner. Secondly, it produces a much narrower particle size distribution and a smaller number of large particles, thus improving quality. Finally, it can run at about 20% higher rate with a lower motive gas requirement in the grinding chamber.

SUMMARY OF THE INVENTION

This invention relates to a deep-chamber, stepped, fluid-energy mill, for comminuting particulate material, said fluid-energy mill comprising:

(a) a cover, comprising a first circular-shaped axial wall;

(b) a base, comprising a second circular-shaped axial wall opposing said first circular-shaped axial wall, and a peripheral wall extending from said second circular-shaped axial wall;

wherein said first circular-shaped axial wall, said second circular-shaped axial wall, and said peripheral wall define a disc-shaped chamber of a radius R;

(c) a multiplicity of inlets extending through said peripheral wall of said base and aligned for directing grinding fluid into said disc-shaped chamber;

(d) a feed-inlet integral, attached to said first circular-shaped axial wall of said cover, on the side opposite to that side of said first circular-shaped axial wall of said cover, which forms said disc-shaped chamber;

(e) a discharge tube for withdrawing said particulate material and grinding fluid along the axis of said disc-shaped chamber;

wherein at least one of said first circular-shaped axial wall and said second circular-shaped axial wall, on their respective sides that form said disc-shaped chamber, have at least one ring-shaped discontinuity concentric to the disc-shaped grinding chamber extending from said first circular-shaped axial wall and/or said second circular-shaped axial wall into said disc-shaped chamber;

wherein said at least one ring-shaped discontinuity is located concentrically to said disc-shaped chamber at a distance of from about 0.59 R to about 0.62 R from the axis of said disc-shaped grinding chamber; and wherein said discontinuity of said first circular-shaped wall, and said discontinuity of said second circular-shaped wall are symmetrically placed from the center of said disc-shaped grinding chamber;

wherein said disc-shaped chamber is lined with a ceramic liner;

wherein said ceramic liner extends from the inside of said disc-shaped chamber to the inside of said feed-inlet integral thereby defining the feed-inlet tube;

wherein said feed-inlet integral has a packing gland that floats between said feed-inlet tube and said inside wall of said feed-inlet integral;

wherein said feed-inlet tube is optionally tapered in the direction opposite of the grinding fluid flow;

wherein, optionally, said feed-inlet integral and said cover form a single unit; and wherein said discharge tube is lined with a second ceramic liner and wherein the joint between said liner and said second ceramic liner is shaped such that the direction of said grinding fluids and said particulate material, exiting said disc-shaped chamber, is opposite to the direction of said grinding fluids and said particulate material required to impinge and penetrate said joint of said ceramic liner and said second ceramic liner.

This invention also relates to a method for reducing the size of particulate material, comprising:

(a) supplying particulate material and a first grinding fluid to a deep-chamber, stepped, fluid-energy mill, for comminuting said particulate material, said fluid-energy mill comprising:

(i) a cover, comprising a first circular-shaped axial wall;

(ii) a base, comprising a second circular-shaped axial wall opposing said first circular-shaped axial wall, and a peripheral wall extending from said second circular-shaped axial wall;

wherein said first circular-shaped axial wall, said second circular-shaped axial wall, and said peripheral wall define a disc-shaped chamber of a radius R;

(iii) a multiplicity of inlets extending through said peripheral wall of said base and aligned for directing second grinding fluid into said disc-shaped chamber;

(iv) a feed-inlet integral, attached to said first circular-shaped axial wall of said cover, on the side opposite to that side of said first circular-shaped axial wall of said cover, which forms said disc-shaped chamber;

(v) a discharge tube for withdrawing said particulate material that has been subjected to grinding, said first grinding fluid, and said second grinding fluid along the axis of said disc-shaped chamber;

wherein at least one of said first circular-shaped axial wall and said second circular-shaped axial wall, on their respective sides that form said disc-shaped chamber, have at least one ring-shaped discontinuity concentric to the disc-shaped grinding chamber extending from said first circular-shaped axial wall and/or said second circular-shaped axial wall into said disc-shaped chamber;

wherein said at least one ring-shaped discontinuity is located concentrically to said disc-shaped chamber at a distance of from about 0.59 R to about 0.62 R from the axis of said disc-shaped grinding chamber;

wherein said disc-shaped chamber is lined with a ceramic liner;

wherein said ceramic liner extends from the inside of said disc-shaped chamber to the inside of said feed-inlet integral thereby defining the feed-inlet tube;

wherein said feed-inlet integral has a packing gland that floats between said feed-inlet tube and said inside wall of said feed-inlet integral;

wherein said feed-inlet tube is optionally tapered in the direction opposite of said first grinding fluid flow;

wherein, optionally, said feed-inlet integral and said cover form a single unit; and wherein said discharge tube is lined with a second ceramic liner and wherein the joint between said liner and said second ceramic liner is shaped such that the direction of said first grinding fluid, said second grinding fluid, and said particulate material, exiting said disc-shaped chamber, is opposite to the direction of said grinding fluids and said particulate material required to impinge and penetrate said joint of said ceramic liner and said second ceramic liner;

(b) supplying said second grinding fluid through said multiplicity of inlets on said peripheral wall;

(c) operating said fluid-energy mill wherein said grinding fluids operate at a velocity of from about 0.5 Mach to about 7 Mach; and (d) withdrawing said first and said second grinding fluid and said particulate material subjected to grinding from said discharge tube.

BRIEF DESCRIPTION OF THE DRAWINGS

Many aspects of the embodiments of the present invention can be more fully understood with reference to the following drawings. The components set forth in the drawings are not necessarily to scale. Moreover, in the drawings, the reference numerals designate corresponding parts throughout the several views.

DETAILED DESCRIPTION OF THE INVENTION

Figure 1:
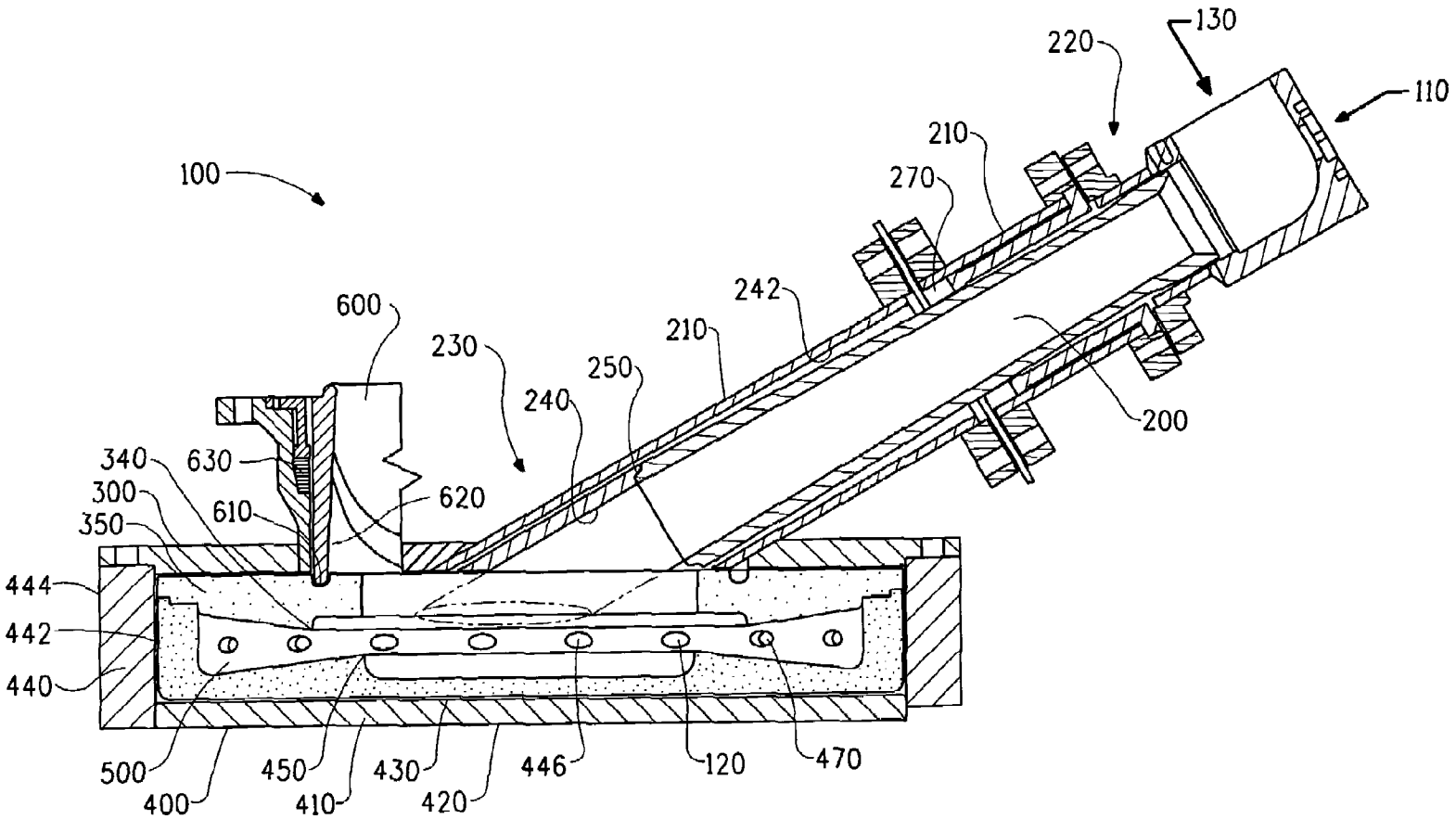
FIG. 1 shows a general schematic of fluid-energy mill being fed with grinding fluid and particulate material to be ground.

Unless otherwise defined, all technical and scientific terms used herein have the same meaning as commonly understood by one of ordinary skill in the art to which this invention belongs. In case of conflict, the present specification, including definitions, will control.

Although methods and materials similar or equivalent to those described herein can be used in the practice or testing of the present invention, suitable methods and materials are described herein.

When an amount, concentration, or other value or parameter is given as either a range, preferred range or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

When the term "about" is used in describing a value or an end-point of a range, the disclosure should be understood to include the specific value or end-point referred to.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive 'or' and not to an exclusive 'or.' For example, a condition A or B is satisfied by any one of the following: A is true (or present) and B is false (or not present), A is false (or not present) and B is true (or present), and both A and B are true (or present).

Use of "a" or "an" are employed to describe elements and components of the invention. This is done merely for convenience and to give a general sense of the invention. This description should be read to include one or at least one, and the singular also includes the plural unless it is obvious that it is meant otherwise.

The materials, methods, and examples herein are illustrative only and, except as specifically stated, are not intended to be limiting.

By "grinding" of particulate material is meant a possible "size reduction" of particulate material. The term "grinding" and the term "size reduction" may be used interchangeably in this application. Both the terms are equivalent in their meaning.

The term "discontinuity" is used herein in its accepted fluid flow sense to define intersecting surfaces, i.e., as opposed to curved surfaces, over which a grinding fluid cannot flow without creating at least some small boundary zone of reduced pressure. Advantageously, the discontinuities in the axial walls of the fluid-energy mill of the invention will be abruptly divergent, i.e. step-shaped in cross-section as would be defined by surfaces intersecting at less than, for example, 135°. Preferably, the angle of intersecting surfaces is less than about 90°. It should be noted that regardless of the shape of the discontinuities, the axial walls may be relatively planar or may be converging.

Generally, the present invention relates to a deep-chamber, stepped, fluid-energy mill or a micronize, and its use in grinding of particulate material. Particulate material, for example pigment particulates, is entrained in a jet flow with a grinding fluid and injected into the chamber of the fluid-energy mill through at least one feed-inlet tube. A high-velocity feed jet may be used for introducing such particulate material into the chamber of the fluid-energy mill. Particulate material as feed can be introduced either through a feed-inlet tube on the side that is tangential to the grinding chamber, or at an angle from the top, for example at about 30° angle parallel to the plane of the grinding chamber.

The particulate material and the grinding fluid then enter a circular, trapezoidal-shaped ring situated around the main body of the fluid-energy mill. This ring is surrounded by circumferentially located (radially oriented, tangentially oriented, or oriented at an angle in between the radial and the tangential) small jets, for example, supersonic jets. The jets provide additional grinding fluid to the chamber, which further adds grinding energy. The shape and orientation of these jets is critical to maximize their efficiency to grind the larger classified particles.

The mill operates by impaction grinding of the feed as it is hurtled against the walls of the chamber by the accelerating action of the grinding fluids from the jets. The particulate material circulates around the chamber, where attrition grinds the particles to smaller and smaller sizes. Based on the grinding fluid (steam, for example) and the nature and velocity of the particles controlled by the operation of the mill, a very fine particle size distribution can be achieved.

Once the particles have achieved the desired size, they are removed with the grinding fluid out of the chamber through the discharge tube and into the collection device, such as a bag filter. The circumferential jets provide additional momentum to the particulate material and the grinding fluid, which helps in classification of the grinding powder. When the ground particulate material becomes sufficiently small, classification forces allow the particulate material to be ejected axially and vertically (assuming that the fluid-energy mill was oriented horizontally). Coarse particles continue to be comminuted and classified until desired size is obtained.

Exemplary diameters of the grinding chamber include 27 inches and 36 inches.

The present invention is an improvement over previous designs in several ways. Particularly, in one embodiment, the trapezoidal grinding chamber is defined by the discontinuities that are concentric to the chamber axis, located at a distance of from about 0.59 to 0.62 R, wherein R is the radius of the circular grinding chamber measured from the axis to the inside wall of chamber. Therefore the depth of the grinding chamber is deeper than previous designs. A preferred location of the ring-shaped discontinuities is about 0.61 R from the central axis of the disc-shaped grinding chamber.

In previous designs, the feed-inlet tube entrance was the same size as the chamber width. Therefore, the particulate material entering the grinding chamber had a higher probability of spilling into the discharge. By creating a deeper chamber in the present invention, the feed-inlet tube entrance can be retained in the same position. With a deeper chamber, higher centripetal force is generated which holds the larger particles in the grinding chamber for a longer time providing a higher probability of comminution to the desired particle size. As a result, the particle size is better defined with an improvement in the gloss of the finished product. Moreover, the number of scattered particles is reduced. For example, in paint applications scattered particles tend to be the large unground particulate matter that eventually appear as aberration in a paint film.

Grinding of particulate material such as titanium dioxide results in abrasion of the inside walls of the fluid-energy mill. Generally, a ceramic liner is used to mitigate the effect of such abrasion. The ceramic liner is generally a large casting of silicon carbide, which because of its size, has many joints. However, the joints can be a potential source of leakage because the particulate material, moving at a velocity of about Mach 0.5 to Mach 7, can penetrate the liner joints. In fact, at this momentum, particulate material can penetrate through even the smallest of opening in the liner joints. In order to circumvent the problem, the design of the present invention incorporates interlocking joints, particularly, in the discharge tube taking the grinding fluid and the ground particulate material away from the chamber after grinding and classification has been accomplished. The interlocking joint uses the flow direction and velocity to an advantage. Particularly, the joints are designed in such manner that the particulate material is likely to penetrate the joints only if the particulate material were to flow in a reverse direction to get past the interlocking joint. By "reverse direction" is meant the direction opposite to the direction of the grinding fluid as it exits the chamber. The interlocking joint is designed to seal against the flow of the particulate material, without precluding the movement between the parts for thermal expansion. Furthermore, the discharge tube is also sealed by a packing joint and a packing follower, forming a bypass resistant seal.

The particulate material can also penetrate the liner at the feed-inlet tube's entry point into the grinding chamber. In a conventional fluid-energy mill, the feed-inlet tube penetrates the ceramic liner of the inner wall of the top circular plate or the cover of the fluid-energy mill. The liner at the entry point is susceptible to penetration by particulate material, which results in increased liner wear and loss of product quality. In one embodiment of the present invention, the feed-inlet tube entrance is cast into an extension from the top cover. The extension, also known as the feed-inlet integral, forms a single cast unit with the top cover. Therefore, the liner within the feed-inlet tube forms a joint, sufficiently away from the grinding chamber where high-momentum particulate material is ground, thereby reducing the likelihood of liner wear. In another embodiment of the invention, the feed-inlet tube, which in conventional design is straight, is tapered on the inside to expand as the feed approaches the grinding chamber. This alleviates a shock from forming in the feed-inlet tube, which would greatly affect feed vacuum and hence feed rate. As a result, the fluid-energy mill maintains feed vacuum over a much higher rate.

In another embodiment of the invention, in order to better seal the feed-inlet tube and to prevent mechanical stresses from breaking it, a packing gland is placed in between the feed-inlet tube and the inside wall of the feed-inlet integral. The packing gland floats in the liner and seals the feed tube.

As a result of the above improvements of the present invention, it has been found that the liner lasts about two to three times longer than a standard liner. Further it produces a much narrower size distribution of the particulate material. It has also been found that the grinding fluid requirement (for example, steam), is reduced by about 20%.

The embodiments of the present invention may be utilized in the particle-size reduction of a wide variety of particulate material. Non-limiting examples of suitable types of particulate material include pigments, agricultural chemicals, carbon black, ceramics, minerals and metals, pharmaceuticals, cosmetics, precious metals, propellants, resins, toner and titanium dioxide. Grinding combinations of a variety of particulate material may also be performed. Typically, the particulate material is entrained in a grinding fluid feed stream, which may be compressed air or other gas or a combination of gases.

In one embodiment, this invention relates to a deep-chamber, stepped, fluid-energy mill, for comminuting particulate material, said fluid-energy mill comprising:

(a) a cover, comprising a first circular-shaped axial wall;

(b) a base, comprising a second circular-shaped axial wall opposing said first circular-shaped axial wall, and a peripheral wall extending from said second circular-shaped axial wall;

wherein said first circular-shaped axial wall, said second circular-shaped axial wall, and said peripheral wall define a disc-shaped chamber of a radius R;

(c) a multiplicity of inlets extending through said peripheral wall of said base and aligned for directing grinding fluids into said disc-shaped chamber;

(d) a feed-inlet integral, attached to said first circular-shaped axial wall of said cover, on the side opposite to that side of said first circular-shaped axial wall of said cover, which forms said disc-shaped chamber;

(e) a discharge tube for withdrawing said particulate material and grinding fluid along the axis of said disc-shaped chamber;

wherein at least one of said first circular-shaped axial wall and said second circular-shaped axial wall, on their respective sides that form said disc-shaped chamber, have at least one ring-shaped discontinuity concentric to the disc-shaped grinding chamber extending from said first circular-shaped axial wall and/or said second circular-shaped axial wall into said disc-shaped chamber; wherein said at least one ring-shaped discontinuity is located concentrically to said disc-shaped chamber at a distance of from about 0.59 R to about 0.62 R from the axis of said disc-shaped grinding chamber;

wherein said disc-shaped chamber is lined with a ceramic liner;

wherein said ceramic liner extends from the inside of said disc-shaped chamber to the inside of said feed-inlet integral thereby defining the feed-inlet tube;

wherein said ceramic liner has a packing gland that floats between said feed-inlet tube and said inside wall of said feed-inlet integral;

wherein said feed-inlet tube is optionally tapered in the direction opposite of the grinding fluid flow;

wherein, optionally, said feed-inlet integral and said cover form a single unit; and wherein said discharge tube is lined with a second ceramic liner and wherein the joint between said liner and said second ceramic liner is shaped such that the direction of said grinding fluids and said particulate material, exiting said disc-shaped chamber, is opposite to the direction of said grinding fluids and said particulate material required to impinge and penetrate said joint of said ceramic liner and said second ceramic liner.

FIG. 1 shows a perspective in cross section of the fluid-energy mill or the micronizer (100) of the present invention. The operation of a fluid-energy mill (100) includes the use of a first grinding fluid (110) and a second grinding fluid (120). The first grinding fluid (110) or the second grinding fluid (120) may comprise a single fluid or a combination of fluids thereby forming a composite fluid stream. The combinations of fluids and the proportions of each fluid therein may be varied to meet the necessary parameters for the particular grinding application.

Non-limiting examples of grinding fluids include air, nitrogen, steam and combinations thereof, wherein steam is preferred. Composite fluid streams may comprise steam and a second gas or other combination of gases.

Typically, depending upon the grinding fluid to be used, the first or the second grinding fluid is delivered at a particular temperature and pressure. Such parameters are known to those skilled in the art. For example, steam is often heated to a temperature ranging from about 220° C. to about 340° C., preferably ranging from about 260° C. to about 305° C. prior to delivery into the spiked nozzle. Preferably, it is supplied at a pressure of about 375 psi (2.580 MPa) to about 500 psi (3.450 MPa), more preferably ranging from about 390 psi (2.688 MPa) to about 440 psi (3.032 MPa). From calculations, it can be shown that at the above-described parameters, the grinding fluid having a velocity (when measured at the point of discharge from the spiked nozzle) of up to about Mach 6.8 (A speed of Mach 1 corresponds to the speed of sound, which is about 340 m/s. A speed of Mach 6.8 is 6.8 times the speed of sound, i.e., about 2312 m/s). It should be noted that Mach number relates to the velocity of sound in a medium and sound moves faster in steam than in air.

As shown in FIG. 1, particulate material (130) is supplied to the fluid-energy mill (100) through a feed jet (not shown), wherein the first grinding fluid (110) entrains the particulate material (130) fed to the feed jet (not shown). The particulate material (130) is then carried through a feed-inlet tube (200) into the fluid-energy mill (100) through a feed-inlet integral (210). The fluid-energy mill (100) comprises of a top wall also known as the cover (300) and a base (400). The cover (300) and the base (400) define the grinding chamber (500). The inner walls of the cover (300) and the base (400) together define the trapezoidal, ring-shaped, grinding chamber (500) of the fluid-energy mill (100) in which the particulate material (130) is entrained through the feed-inlet tube (200) as shown in FIG. 1. After the particulate material (130) is ground in the grinding chamber (500), the grinding fluids (110, and 120) now mixed, and the ground particulate material (130) are removed through an axially located discharge tube (600; shown horizontally displaced in FIG. 1 for clarity) attached to the cover (300) of the fluid-energy mill (100).

Cover and Feed-Inlet Integral

Figure 2:
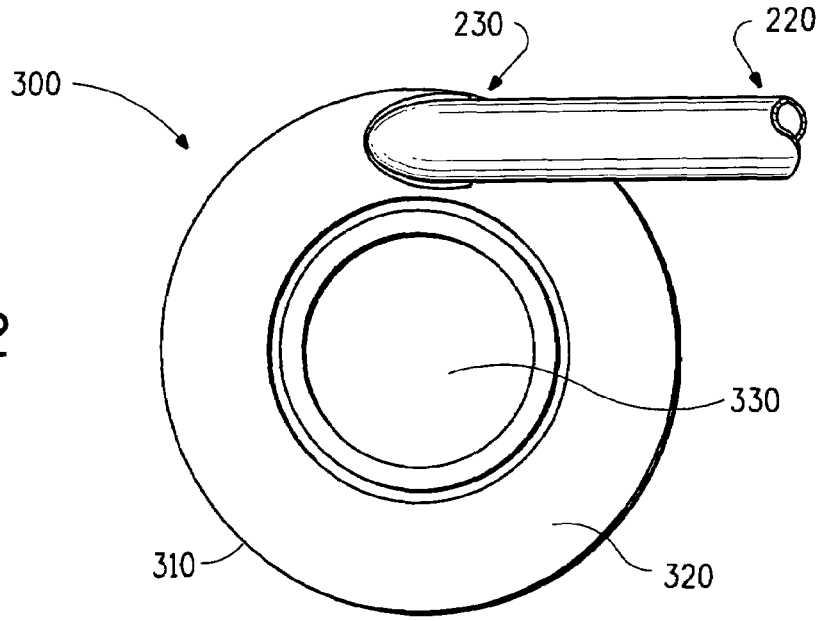
FIG. 2 shows the top view of the cover of the fluid-energy mill.

As shown in FIG. 1 and FIG. 2, the cover (300) comprises of a ring-shaped circular disc with an annulus (330), with an outer wall (310) and an inner wall (320). To the cover (300) is attached the feed-inlet integral (210) that houses the feed-inlet tube (200). Optionally, the feed-inlet integral (210) and the cover (300) form a single cast unit.

The feed-inlet integral (210) houses the feed-inlet tube (200). Entrained first grinding fluid (110) and the particulate material (130) enter the distal end (220) of the feed-inlet tube (200). The distal end (220) of the feed-inlet tube (200) is optionally narrower than its proximal end (230). The tapering of the feed-inlet tube (200) that expands the tube as the feed approaches the entry-point into the fluid-energy mill (100) helps avoid the shock that would otherwise build up which would greatly affect feed vacuum and hence feed rate. Thus, the feed vacuum can be maintained over a much higher rate.

The feed-inlet integral (210) has a liner (240) on the inside wall (242), preferably made from ceramic such as silicon carbide, that extends into the feed-inlet integral (210) from the grinding chamber (500) and forms a joint (250) with the feed-inlet tube (200) inside the feed-inlet integral (210) such that the probability of the particulate material (130) penetrating the joint (250) and creating a leak and wear of the inside liner (240) is reduced. Because the direction of the particulate material (130) in the feed-inlet tube (200) and the feed-inlet integral (210) is parallel to the walls of the feed-inlet integral (210), and because the particulate velocity is not as high as it is in the grinding chamber 500, the probability of particulate penetration into the liner at the joint (250) is less.

The feed-inlet integral (210) also comprises a packing gland (270) placed in between the inside wall (242) of the feed-inlet integral (210) and the feed-inlet tube (240). This packing gland (270) is essentially movable along the axis of the feed-inlet integral (210), as it floats behind the liner (240). The feed inlet integral (210) forms an angle of about 10° to about 90° with the plane of the cover. Preferably, the angle is about 30°.

Figure 3:
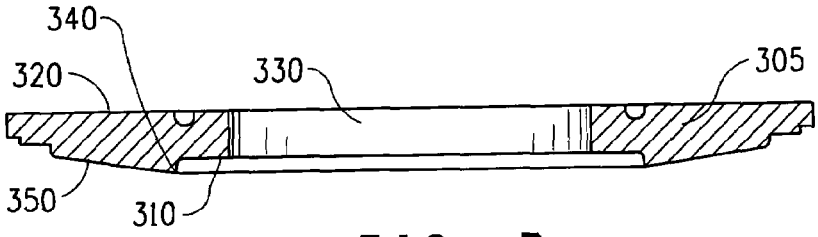
FIG. 3 shows the side view of the cover of the fluid-energy mill.

FIG. 3 is the side view of the cover (300). On the inner wall (320) of the cover (300) is a ring-shaped, discontinuity (340). The discontinuity (340) is located at a radial distance in the range of from about 0.59 R to about 0.62 R, wherein R is measured as the radius of the cover. Preferably, the location of the discontinuity (340) is at about 0.61 R. More than one discontinuity can be present on the inner wall (310) of the cover (300). It is preferred that the discontinuity effect a change in the chamber height of about 5 to 50%.

Where the mill is to be used for comminuting hard, crystalline, inorganic materials such as rutile or anatase titanium dioxide, the grinding chamber (500) is provided with suitably shaped liners of hardened alloy or refractory carbides. Silicon carbide is preferred. The inner wall (310) of the cover (300) is lined with a protective liner (350), such as a ceramic liner, preferably, silicon carbide.

The Base

Figure 4:
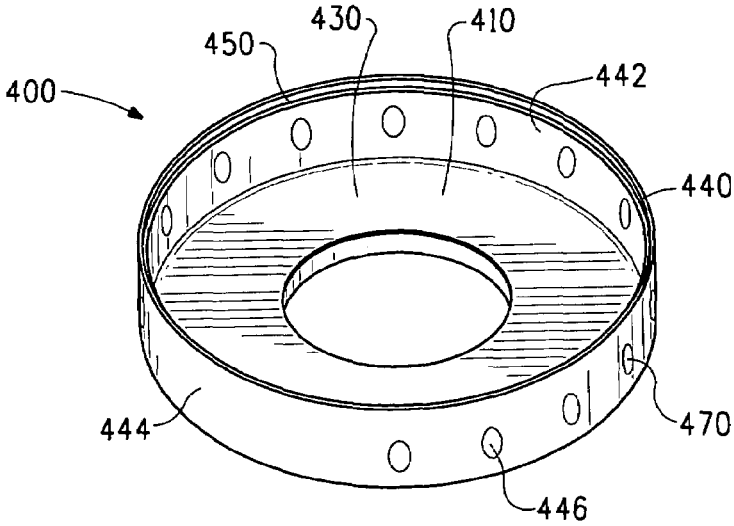
FIG. 4 shows the perspective view of the base of the fluid-energy mill.
Figure 5:
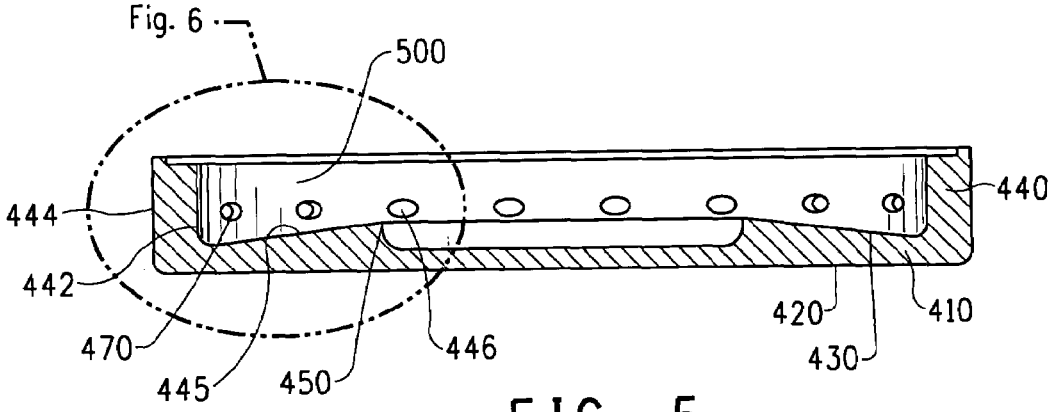
FIG. 5 shows the side view of the base of the fluid-energy mill.

FIG. 4 shows a perspective view of the base (400) of the fluid-energy mill (100). As shown in FIG. 4, and FIG. 5, the base (400) comprises an axial wall (410) having an outer wall (420) and an inner wall (430). The base (400) further comprises a peripheral wall (440) generally perpendicular to the axial wall (410). The peripheral wall comprises of the inner peripheral wall (442) and the outer peripheral wall (444).

Figure 6:
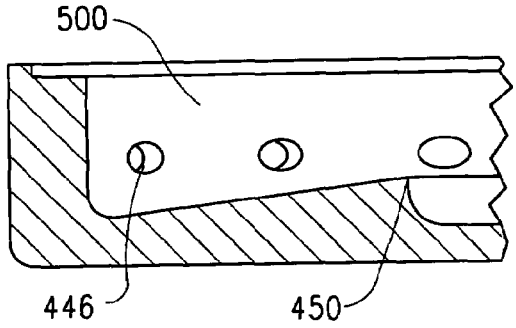
FIG. 6 shows a close-up view of the stepped discontinuity in the base of the fluid-energy mill.

On the inner wall (430) of the base (400) is a ring-shaped, discontinuity (450). FIG. 6 shows a closer view of the discontinuity (450). The discontinuity (450) is located at a radial distance in the range of from about 0.59 R to about 0.62 R, wherein R is measured as the radius of the cover. Preferably, the location of the discontinuity (450) is at about 0.61 R. More than one discontinuity can be present on the inner wall (430) of the cover (400). It is preferred that the discontinuity (450) of the base (400), in combination with the discontinuity (340) of the cover (300), effect a change in the chamber height of about 5 to 50%. Normally, a projection of the discontinuity of at least ⅛ inch is desired, for an R value of 12-18 inches. A preferred minimum is 0.1 inch of the height of the discontinuities (340 and 450) to give a total change in the grinding chamber (500) height of 0.2 inch is desired.

Where the mill is to be used for comminuting hard, crystalline, inorganic materials such as rutile or anatase titanium dioxide, the inner wall (430) of the base (400), defining the grinding chamber (500) is provided with suitably shaped liners of hardened alloy or refractory carbides. Silicon carbide is preferred. The inner wall (430) of the base (400) is lined with a protective liner (445), such as a ceramic liner, preferably, silicon carbide.

The discontinuity (340) originating from the cover (300) and the discontinuity (450) originating form the base (400), can be equidistant from the axis of the fluid-energy mill (100), or they may not be equidistant from said axis. The cover (300) and the base (400) can have the same number of discontinuities or different number of discontinuities.

The peripheral wall (440) of the base (400) is generally perpendicular to the axial wall (410) of the base. Located on the outer peripheral wall (444) are a multiplicity of circumferential jets (470; actual jet schematic is not shown; only shown are the entry-points (446) for the circumferential jets). As described previously, the circumferential jets (470) provide the second grinding fluid (120) that aids in grinding of the particulate material (130).

Ordinary jets can be used as circumferential jets, for example, standard DeLaval nozzle. Spiked nozzle-shaped ring jets, described in U.S. patent application Ser. No. 11/269,777 (assigned to E.I. du Pont de Nemours and Co.), can also be used as circumferential jets. Said reference is incorporated by reference herein as if fully set forth.

In one embodiment, the fluid-energy mill (100) has at least one circumferential jet (470). In another embodiment, the fluid-energy mill (100) can have as many as 50 circumferential jets (470) placed about the fluid-energy mill (100) in the circular orientation. In one embodiment, a circumferential jet may be placed equidistant from its two neighboring circumferential jets. In another embodiment, a circumferential jet may not be placed equidistant from its two neighboring circumferential jets. In another embodiment, some circumferential jets may be placed equidistant from their neighbors and other circumferential jets may not be placed equidistant from their neighbors. In other embodiments, the range of the number of circumferential jets is selected from the group consisting of 1 to 5, 1 to 10, 1 to 15, 1 to 20, 1 to 25, 1 to 30, 1 to 35, 1 to 40, 1 to 45, 1 to 50, 1 to 3, 4 to 6, 7 to 9, 10 to 12, 13 to 15, 16 to 18, 19 to 21, 22 to 24, 25 to 27, 28 to 30, 31 to 33, 34 to 36, 37 to 39, 40 to 42, 43 to 45, 46 to 48, and 49 to 50.

Where the fluid-energy mill is to be used for comminuting hard, crystalline, inorganic materials such as rutile or anatase titanium dioxide, the grinding chamber (500) is provided with suitably shaped liners of hardened alloy or refractory carbides on the inner wall (430) and the inner wall (442) of the peripheral wall (440). Silicon carbide is preferred. The inner wall (310) of the cover (300) is lined with a protective liner (350), such as a ceramic liner, preferably, silicon carbide.

The Grinding Chamber

The cover (300) and the base (400), by way of their inner walls (310 and 430 respectively) and the inner peripheral wall (442) define the grinding chamber (500). The grinding chamber is designed to have a trapezoidal shape in the cross section. In one embodiment, both, the inner wall (310) of the cover (300) and the inner wall (430) of the base (400) are tapered inward in such manner that the height of the grinding chamber (500) at the inner peripheral wall (442) is more than the height of the grinding chamber (500) at the point of discontinuities (340 and 450) for the cover (300) and the base (400), respectively.

The Discharge Tube

FIG. 1 shows the discharge tube (600). In actual embodiment of the fluid-energy mill (100), the discharge tube (600) is axially located. In FIG. 1, it is shown displaced to the left of the axis of the fluid-energy mill, for the purposes of clarity. Particulate material that have been ground to a desired cut size, and the grinding fluids exit the fluid-energy mill (100) into the discharge tube (600).

Because the grinding fluid velocity is very high, particulate material with very high momenta impinge on the inside walls of the grinding chamber as well as the discharge tube. As a result, the discharge tube is subjected to high amounts of mechanical wear from the hard particulate material. The discharge tube is covered by a second liner (620), made from ceramic, preferably silicon carbide to mitigate the wear from the high-impact particulate impingement. However, even a ceramic liner suffers wear in such harsh conditions. Particularly, the joint (610), is susceptible to wear and penetration from high-impact, solid particles of the particulate material (130). In the present invention, the joint (610) is designed as an interlocking joint. In other words, for a particulate material to penetrate the joint in the discharge tube, it would have to reverse direction. Also embedded behind the second liner (620) is the packing follower (630) that helps seal the liner (620) to the discharge tube (600). Thus, the discharge tube (600) is sealed by the use of a packing joint (610) and packing follower (630). Together, this forms a bypass resistant seal.

Process of Particulate Size Reduction

The embodiments of the present invention further contemplate a method of reducing the size of particulate material. In one embodiment, the method comprises the following steps:

(a) supplying particulate material (130) and a first grinding fluid (110) to a deep-chamber, stepped, fluid-energy mill (100), for comminuting said particulate material (130), said fluid-energy mill (100) comprising:

(i) a cover (300), comprising a first circular-shaped axial wall;

(ii) a base (400), comprising a second circular-shaped axial wall (410) opposing said first circular-shaped axial wall (305), and a peripheral wall (440) extending from said second circular-shaped axial wall (410);

wherein said first circular-shaped axial wall (305), said second circular-shaped axial wall (410), and said peripheral wall (440) define a disc-shaped grinding chamber (500) of a radius R;

(iii) a multiplicity of inlets (446) extending through said peripheral wall (440) of said base (400) and aligned for directing second grinding fluid (120) into said disc-shaped grinding chamber (500);

(iv) a feed-inlet integral (210), attached to said first circular-shaped axial wall (305) of said cover (300), on the side opposite to that side of said first circular-shaped axial wall (305) of said cover (300), which forms said disc-shaped grinding chamber (500);

(v) a discharge tube (600) for withdrawing said particulate material (130) that has been subjected to grinding, said first grinding fluid (110), and said second grinding fluid (120) along the axis of said disc-shaped grinding chamber (500);

wherein at least one of said first circular-shaped axial wall (305) and said second circular-shaped axial wall (410), on their respective sides that form said disc-shaped grinding chamber (500), have at least one ring-shaped discontinuity (340 and 450) concentric to the disc-shaped grinding chamber (500) extending from said first circular-shaped axial wall (305) and/or said second circular-shaped axial wall (410) into said disc-shaped grinding chamber (500); wherein said discontinuities (340 and 450) are defined by planes intersecting at an angle less than about 135°, preferably, less than 90°.

wherein said at least one ring-shaped discontinuity (340 or 450) is located concentrically to said disc-shaped grinding chamber (500) at a distance of from about 0.59 R to about 0.62 R from the axis of said disc shaped grinding chamber (500);

wherein said disc-shaped grinding chamber (500) is lined with a ceramic liner (350, 445);

wherein said ceramic liner (350) extends from the inside of said disc-shaped chamber to the inside of said feed-inlet integral (210) thereby defining the feed-inlet tube (200);

wherein said feed inlet integral (210) has a packing gland (270) that floats between said feed-inlet tube (200) and said inside wall (242) of said feed-inlet integral (210);

wherein said feed-inlet tube (200) is optionally tapered in the direction opposite of said first grinding fluid (110) flow;

wherein, optionally, said feed-inlet integral (210) and said cover (300) form a single unit; and wherein said discharge tube (600) is lined with a second ceramic liner (620) and wherein the joint (610) between said liner (340) and said second ceramic liner (620) is shaped such that the direction of said grinding fluids (110, 120) and said particulate material (130), exiting said disc-shaped grinding chamber (500), is opposite to the direction of said grinding fluids (110, 120) and said particulate material (130) required to impinge and penetrate said joint (610) of said ceramic liner (350) and said second ceramic liner (620).

(b) supplying said second grinding fluid (120) through said multiplicity of inlets (446) on said peripheral wall (440);

(c) operating said fluid-energy mill (100) wherein said grinding fluids (110, 120) operate at a velocity of from about 0.5 Mach to about 7 Mach, preferably 0.5 to 2.5 Mach; and (d) withdrawing said grinding fluids (110, 120) and said particulate material (130) subjected to grinding from said discharge tube (600).

What is claimed is:

1. A deep-chamber, stepped, fluid-energy mill, for comminuting particulate material, said fluid-energy mill comprising:

(a) a cover, comprising a first circular-shaped axial wall;

(b) a base, comprising a second circular-shaped axial wall opposing said first circular-shaped axial wall, and a peripheral wall extending from said second circular-shaped axial wall;

wherein said first circular-shaped axial wall, said second circular-shaped axial wall, and said peripheral wall define a disc-shaped chamber of a radius R;

(c) a multiplicity of inlets extending through said peripheral wall of said base and aligned for directing grinding fluids into said disc-shaped chamber;

(d) a feed-inlet integral, attached to said first circular-shaped axial wall of said cover, on the side opposite to that side of said first circular-shaped axial wall of said cover, which forms said disc-shaped chamber, (e) a discharge tube for withdrawing said particulate material and grinding fluid along the axis of said disc-shaped chamber;

wherein at least one of said first circular-shaped axial wall and said second circular-shaped axial wall, on their respective sides that form said disc-shaped chamber, have at least one ring-shaped discontinuity concentric to the disc-shaped grinding chamber extending from said first circular-shaped axial wall and/or said second circular-shaped axial wall into said disc-shaped chamber;

wherein said at least one ring-shaped discontinuity is located concentrically to said disc-shaped chamber at a distance of from about 0.59 R to about 0.62 R from the axis of said disc-shaped grinding chamber;

wherein said disc-shaped chamber is lined with a first ceramic liner;

wherein said first ceramic liner extends from the inside of said disc-shaped chamber to the inside of said feed-inlet integral thereby defining the feed-inlet tube; wherein said feed-inlet integral has a packing gland that floats between said feed-inlet tube and said inside wall of said feed-inlet integral;

wherein said feed-inlet tube is optionally tapered in the direction opposite of the grinding fluid flow;

wherein, optionally, said feed-inlet integral and said cover form a single unit; and wherein said discharge tube is lined with a second ceramic liner and wherein said first ceramic liner and said second ceramic liner form a joint there between, the joint being shaped such that the direction of said grinding fluids and said particulate material, exiting said disc-shaped chamber, is opposite to the direction of said grinding fluids and said particulate material required to impinge and penetrate said joint of said ceramic liner and said second ceramic liner.

2. The deep-chamber, stepped, fluid-energy mill, as recited in claim 1, wherein said at least one ring-shaped discontinuity is defined by surfaces intersecting at an angle less than about 135°.

3. The deep-chamber, stepped, fluid-energy mill, as recited in claim 1, wherein said at least one ring-shaped discontinuity is defined by surfaces intersecting at an angle less than about 90°.

4. The deep-chamber, stepped, fluid-energy mill, as recited in claim 1, wherein said at least one ring-shaped discontinuity is located concentrically to said disc-shaped chamber at a distance of from about 0.59 R to about 0.62 R from the axis of said disc-shaped grinding chamber.

5. The deep-chamber, stepped, fluid-energy mill, as recited in claim 1, wherein said at least one ring-shaped discontinuity is located concentrically to said disc-shaped chamber at a distance of about 0.61 R from the axis of said disc-shaped grinding chamber.

6. A method for reducing the size of particulate material, comprising:

(a) supplying particulate material and a first grinding fluid to a deep-chamber, stepped, fluid-energy mill, for comminuting said particulate material, said fluid-energy mill comprising:

(i) a cover, comprising a first circular-shaped axial wall;

(ii) a base, comprising a second circular-shaped axial wall opposing said first circular-shaped axial wall, and a peripheral wall extending from said second circular-shaped axial wall;

wherein said first circular-shaped axial wall, said second circular-shaped axial wall, and said peripheral wall define a disc-shaped chamber of a radius R;

(iii) a multiplicity of inlets extending through said peripheral wall of said base and aligned for directing a second grinding fluid into said disc-shaped chamber;

(iv) a feed-inlet integral, attached to said first circular-shaped axial wall of said cover, on the side opposite to that side of said first circular-shaped axial wall of said cover, which forms said disc-shaped chamber;

(v) a discharge tube for withdrawing said particulate material that has been subjected to grinding, said first grinding fluid, and said second grinding fluid along the axis of said disc-shaped chamber;

wherein at least one of said first circular-shaped axial wall and said second circular-shaped axial wall, on their respective sides that form said disc-shaped chamber, have at least one ring-shaped discontinuity concentric to the disc-shaped grinding chamber extending from said first circular-shaped axial wall and/or said second circular-shaped axial wall into said disc-shaped chamber;

wherein said at least one ring-shaped discontinuity is located concentrically to said disc-shaped chamber at a distance of from about 0.59 R to about 0.62 R from the axis of said disc-shaped grinding chamber;

wherein said disc-shaped chamber is lined with a first ceramic liner;

wherein said first ceramic liner extends from the inside of said disc-shaped chamber to the inside of said feed-inlet integral thereby defining the feed-inlet tube;

wherein said feed-inlet integral has a packing gland that floats between said feed-inlet tube and said inside wall of said feed-inlet integral;

wherein said feed-inlet tube is optionally tapered in the direction opposite of said first grinding fluid flow;

wherein, optionally, said feed-inlet integral and said cover form a single unit; and wherein said discharge tube is lined with a second ceramic liner and wherein said first ceramic liner and said second ceramic liner form a joint there between, the joint being shaped such that the direction of said first grinding fluid, said second grinding fluid, and said particulate material, exiting said disc-shaped chamber, is opposite to the direction of said grinding fluids and said particulate material required to impinge and penetrate said joint of said ceramic liner and said second ceramic liner;

(b) supplying said second grinding fluid through said multiplicity of inlets on said peripheral wall;

(c) operating said fluid-energy mill wherein said grinding fluids operate at a velocity of from about 0.5 Mach to about 7 Mach; and (d) withdrawing said first and said second grinding fluid and said particulate material subjected to grinding from said discharge tube.

7. The process as recited in claim 6, wherein said at least one ring-shaped discontinuity is defined by surfaces intersecting at an angle less than about 135°.

8. The process as recited in claim 6, wherein said at least one ring-shaped discontinuity is defined by surfaces intersecting at an angle less than about 90°.

9. The process as recited in claim 6, wherein said at least one ring-shaped discontinuity is located concentrically to said disc-shaped chamber at a distance of from about 0.59 R to about 0.62 R from the axis of said disc-shaped grinding chamber.

10. The process as recited in claim 6, wherein said at least one ring-shaped discontinuity is located concentrically to said disc-shaped chamber at a distance of about 0.61 R from the axis of said disc-shaped grinding chamber.

11. The process as recited in claim 6, wherein said grinding fluids operate at a velocity of from about 0.5 Mach to about 2.5 Mach.

12. The process as recited in claim 6, wherein said particulate material comprises titanium dioxide.

13. The process as recited in claim 6, wherein said first or the second grinding fluid comprises a gaseous fluid selected from the group consisting of air, nitrogen, steam and combinations thereof.

14. The process as recited in claim 6, wherein said first and/or the second grinding fluid comprises steam.

* * * * *